United States Patent [19]

Asai et al.

[11] Patent Number: 4,757,312

[45] Date of Patent: Jul. 12, 1988

[54] IMAGE DISPLAY APPARATUS

[75] Inventors: Nobuteru Asai; Masanobu Nagaoka; Shigeru Matsuoka, all of Hitachi; Yutaka Sato, Katsuta, all of Japan

[73] Assignee: Hitachi, Ltd., Tokyo, Japan

[21] Appl. No.: 750,781

[22] Filed: Jul. 1, 1985

[30] Foreign Application Priority Data

Jun. 29, 1984 [JP] Japan ..... 59-136282
Jan. 22, 1985 [JP] Japan ..... 60-8330

[51] Int. Cl.[4] ..... G09G 1/16

[52] U.S. Cl. ..... 340/750; 340/751; 340/801

[58] Field of Search ..... 340/727, 750, 751, 798–801

[56] References Cited

U.S. PATENT DOCUMENTS 4,271,476 6/1981 Lotspeich ..... 340/727
4,486,745 12/1984 Konno ..... 340/727
4,545,069 10/1985 Kermisch ..... 340/727
4,566,002 1/1986 Miura et al. ..... 340/727

*Primary Examiner*—Marshall M. Curtis
*Attorney, Agent, or Firm*—Antonelli, Terry & Wands

[57] ABSTRACT

An image display apparatus comprises: a computer unit for reading out dot data of an image pattern from a character generator and writing into a bit map type graphic memory; a CRT controller for reading out the dot data from this bit map type graphic memory and displaying on a CRT monitor; and a time sharing control circuit for time sharingly controlling the access from the computer unit to the bit map type graphic memory and the access from the CRT controller to this memory. The character generator is provided with a ROM which is constituted such that a dot matrix of one character pattern is segmented on a byte unit basis in the horizontal direction of raster and these segmented sub-patterns are continuously stored in this ROM in the vertical direction of raster. The time sharing control circuit is provided with an address selector for selecting between address signals providing access to the graphic memory in a vertical scan sequence direction from the computer unit in response to a string instruction and address signals providing access in the horizontal scan direction from the CRT controller in accordance with a predetermined time sharing control.

4 Claims, 20 Drawing Sheets

HIGHER ORDER ADDRESS

| $A_{14}$ | $A_{13}$ | $A_{12}$ | $A_{11}$ | $A_{10}$ | $A_9$ | $A_8$ | $A_7$ | $A_6$ | $A_5$ | $A_4$ | $A_3$ |
|---|---|---|---|---|---|---|---|---|---|---|---|
| 1 | 0 | 1 | 1 | 1 | 0 | 1 | 1 | 1 | 0 | 0 | 0 |

FIG. 9

ROM 1

| ADDRESS | $O_8$ | $O_7$ | $O_6$ | $O_5$ | $O_4$ | $O_3$ | $O_2$ | $O_1$ |
|---|---|---|---|---|---|---|---|---|
| 1194 0h | | | | | | | | |
| 1194 1h | | | | | | | | |
| 1194 2h | | | | | | | | |
| 1194 3h | | | | | | | | |
| 1194 4h | | | | | | | | |
| 1194 5h | | | | | | | | |
| 1194 6h | | | | | | | | |
| 1194 7h | | | | | | | | |
| 1194 8h | | | | | | | | |
| 1194 9h | | | | | | | | |
| 1194 Ah | | | | | | | | |
| 1194 Bh | | | | | | | | |
| 1194 Ch | | | | | | | | |
| 1194 Dh | | | | | | | | |
| 1194 Eh | | | | | | | | |
| 1194 Fh | | | | | | | | |
| 1195 0h | | | | | | | | |
| 1195 1h | | | | | | | | |
| 1195 2h | | | | | | | | |
| 1195 3h | | | | | | | | |
| 1195 4h | | | | | | | | |
| 1195 3h | | | | | | | | |
| 1195 6h | | | | | | | | |
| 1195 7h | | | | | | | | |

| ADDRESS | $O_8$ | $O_7$ | $O_6$ | $O_5$ | $O_4$ | $O_3$ | $O_2$ | $O_1$ |
|---|---|---|---|---|---|---|---|---|
| 1195 8h | | | | | | | | |
| 1195 9h | | | | | | | | |
| 1195 Ah | | | | | | | | |
| 1195 Bh | | | | | | | | |
| 1195 Ch | | | | | | | | |
| 1195 Dh | | | | | | | | |
| 1195 Eh | | | | | | | | |
| 1195 Fh | | | | | | | | |
| 1196 0h | | | | | | | | |
| 1196 1h | | | | | | | | |
| 1196 2h | | | | | | | | |
| 1196 3h | | | | | | | | |
| 1196 4h | | | | | | | | |
| 1196 5h | | | | | | | | |
| 1196 6h | | | | | | | | |
| 1196 7h | | | | | | | | |
| 1196 8h | | | | | | | | |
| 1196 9h | | | | | | | | |
| 1196 Ah | | | | | | | | |
| 1196 Bh | | | | | | | | |
| 1196 Ch | | | | | | | | |
| 1196 Dh | | | | | | | | |
| 1196 Eh | | | | | | | | |
| 1196 Fh | | | | | | | | |

| ADDRESS | $O_8$ | $O_7$ | $O_6$ | $O_5$ | $O_4$ | $O_3$ | $O_2$ | $O_1$ |
|---|---|---|---|---|---|---|---|---|
| 1197 0h | | | | | | | | |
| 1197 1h | | | | | | | | |
| 1197 2h | | | | | | | | |
| 1197 3h | | | | | | | | |
| 1197 4h | | | | | | | | |
| 1197 5h | | | | | | | | |
| 1197 6h | | | | | | | | |
| 1197 7h | | | | | | | | |
| 1197 8h | | | | | | | | |
| 1197 9h | | | | | | | | |
| 1197 Ah | | | | | | | | |
| 1197 Bh | | | | | | | | |
| 1197 Ch | | | | | | | | |
| 1197 Dh | | | | | | | | |
| 1197 Eh | | | | | | | | |
| 1197 Fh | | | | | | | | |
| 1198 0h | | | | | | | | |
| 1198 1h | | | | | | | | |
| 1198 2h | | | | | | | | |
| 1198 3h | | | | | | | | |
| 1198 4h | | | | | | | | |
| 1198 5h | | | | | | | | |
| 1198 6h | | | | | | | | |
| 1198 7h | | | | | | | | |

UPPER LINE : CPU ADDRESS
LOWER LINE : CRT ADDRESS
IN ( )

IMAGE DISPLAY APPARATUS

BACKGROUND OF THE INVENTION

1. Field of the Invention

The present invention relates to an image display apparatus having a memory for storing character patterns for the graphic display system by way of a bit map memory.

2. Description of the Prior Art

Various code refresh systems have been used in a character display apparatus for use in word processors or the like; however, graphic display also is needed to satisfy a demand for display of a graph or a pattern. There is a bit map refresh system for effecting graphic display and this system is suitable to display a graph or a pattern. However, even in the case of the display of characters, a character pattern has to be developed in a bit map memory, so that the bit map refresh system has a drawback in that the display processing speed is slower than that of a conventional display apparatus of the code refresh system.

This problem is also caused in a personal computer having a display apparatus of the bit map refresh system. To avoid such a drawback, a barrel shifter and a bit mask controller are provided in a CRT interface section, thereby improving the display processing speed. However, in the conventional apparatus, the arrangement of pattern data in a character generator is different from an arrangement of memories in a graphic memory, so that the processing function of a CPU cannot be efficiently utilized. Such a personal computer is disclosed in "PC-100 Technical Manual" regarding the general personal computer PC-100 made by Nippon Electric Co., Ltd.

SUMMARY OF THE INVENTION

It is an object of the present invention to realize an image display apparatus in which, even in the case of the display system of the bit map refresh system, the high speed processing function of a CPU can be used with a simple circuit arrangement, and a high display speed is derived in consideration of the above-mentioned problems.

The present invention relates to an image display apparatus comprising: a computer unit which reads out dot data of an image pattern from a character generator section and writes this dot data into a bit map graphic memory; a CRT controller which reads out the dot data from the graphic memory to produce a video signal and displays this video signal on a CRT monitor; and a time sharing control circuit for time sharing control of the graphic memory access by the computer unit and the graphic memory access by the CRT controller, in which the character generator section is provided with memory means which is constituted such that a dot matrix of one character pattern is segmented into sub-patterns on a byte unit basis in the horizontal direction of the display raster and these segmented sub-patterns are continuously stored into one non-volatile memory in the vertical direction of the raster, and the time sharing control circuit is provided with an address selector for switching the address arrangements with respect to the graphic memory access from the computer unit and the graphic memory access from the CRT controller. The access addresses by the computer unit and CRT controller to the graphic memory are arranged so as to be suitable for their respective accesses, thereby realizing a high processing speed.

BRIEF DESCRIPTION OF THE DRAWINGS

FIG. 9 is a diagram showing an arrangement of a CG according to the present invention.

FIGS. 17 to 20 are diagrams for explaining modified forms of the invention, in which:

FIG. 17 is a block diagram of a modified time shartting control circuit;

FIG. 18 is an access address arrangement diagram of a graphic memory; and

FIGS. 19 and 20 are flowcharts for the scroll process.

DESCRIPTION OF THE PREFERRED EMBODIMENTS

Embodiments of the present invention will now be described in detail hereinbelow with reference to the drawings.

Figure 2:
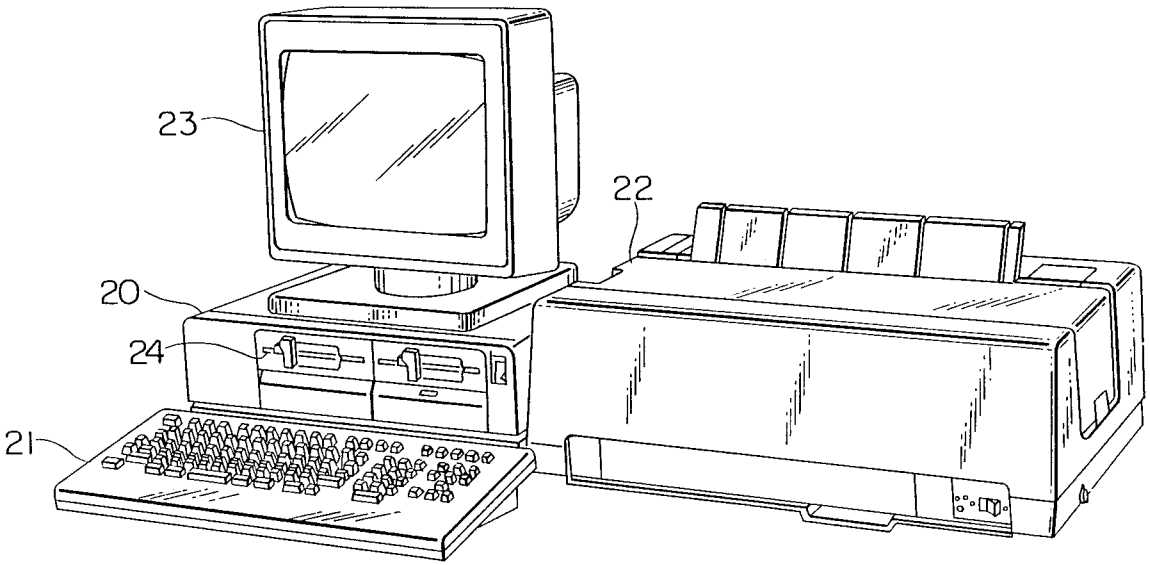
FIG. 2 is an external view of a word processor to which the image display apparatus according to the invention is applied.
Figure 3:
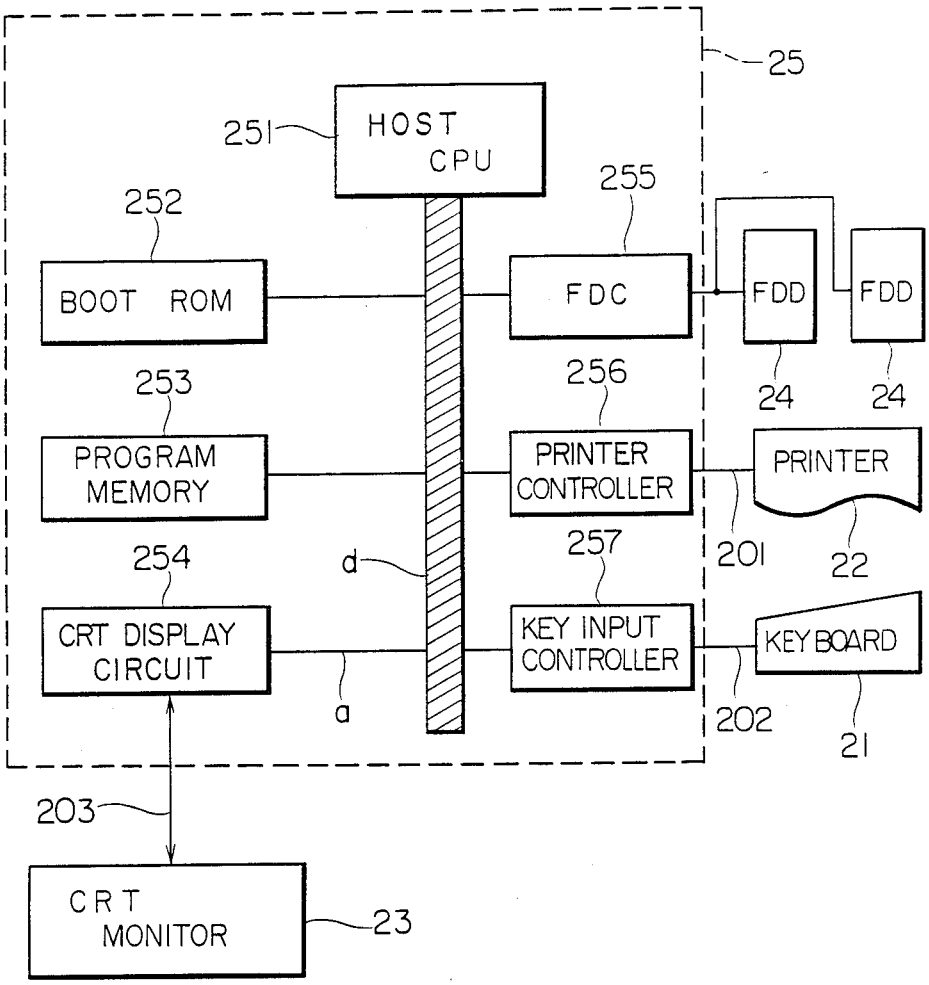
FIG. 3 is a block diagram of a circuit section of the word processor.

A word processor according to the invention, as seen in FIG. 2, comprises: a main body 20 provided with a temporary memory section and a control section; a keyboard 21 serving as an input section; a printer 22 as a printing section; and a CRT monitor 23 as a display section. As shown in FIG. 3, the main body 20 and the printer 22, keyboard 21 and CRT monitor 23 perform the transmission and reception of control signals and information signals through a cable 201, 202 or 203, respectively. In FIG. 2, a reference numeral 24 denotes a flexible disk device (hereinafter, referred to as an FDD) which is integrally attached in the main body 20.

A control section 25 surrounded by a broken line in a control circuit shown in a block diagram of FIG. 3 is provided in the main body 20. Practically speaking, the control section 25 comprises: a host CPU 251 consisting of a stored program computer unit (hereinafter, referred to as a CPU); a boot ROM 252 consisting of a non-volatile memory (hereinafter, referred to as a ROM) and having a program which is executed when a power source is turned on; a program memory 253 consisting of a memory from which readout and into which writing can be performed at any time (hereinafter, this memory is referred to as a RAM), this RAM being used to store a program and information to execute the function as a word processor; a CRT display circuit 254 which produces a screen display pattern in response to a command from the host CPU 251 and transmits a video signal to the CRT monitor 23; a flexible disk control circuit (FDC) 255 to control the FDD 24 in response to a command from the host CPU 251; a printer controller 256 which transmits a signal to control the printer 22 in response to a command from the CPU 251 and a printing signal to the printer 22 and which receives a state signal of the printer 22 therefrom and then transmits to the host CPU 251; a key input controller 257 which controls the keyboard 21 in accordance with a command from the host CPU 251 and transmits the input signal from the keyboard 21 to the host CPU 251; and an internal wiring path d for connecting the host CPU 251, boot ROM 252, program memory 253, CRT display circuit 254, FDC 255, printer controller 256, and key input controller 257.

The FDD 24 drives a flexible disk serving as a magnetic storage medium and records information on this flexible disk or reads out the information from this flexible disk. An opening portion of the FDD 24 according to the foregoing memory section is formed in substantially the front surface of the main body 20.

Figure 4:
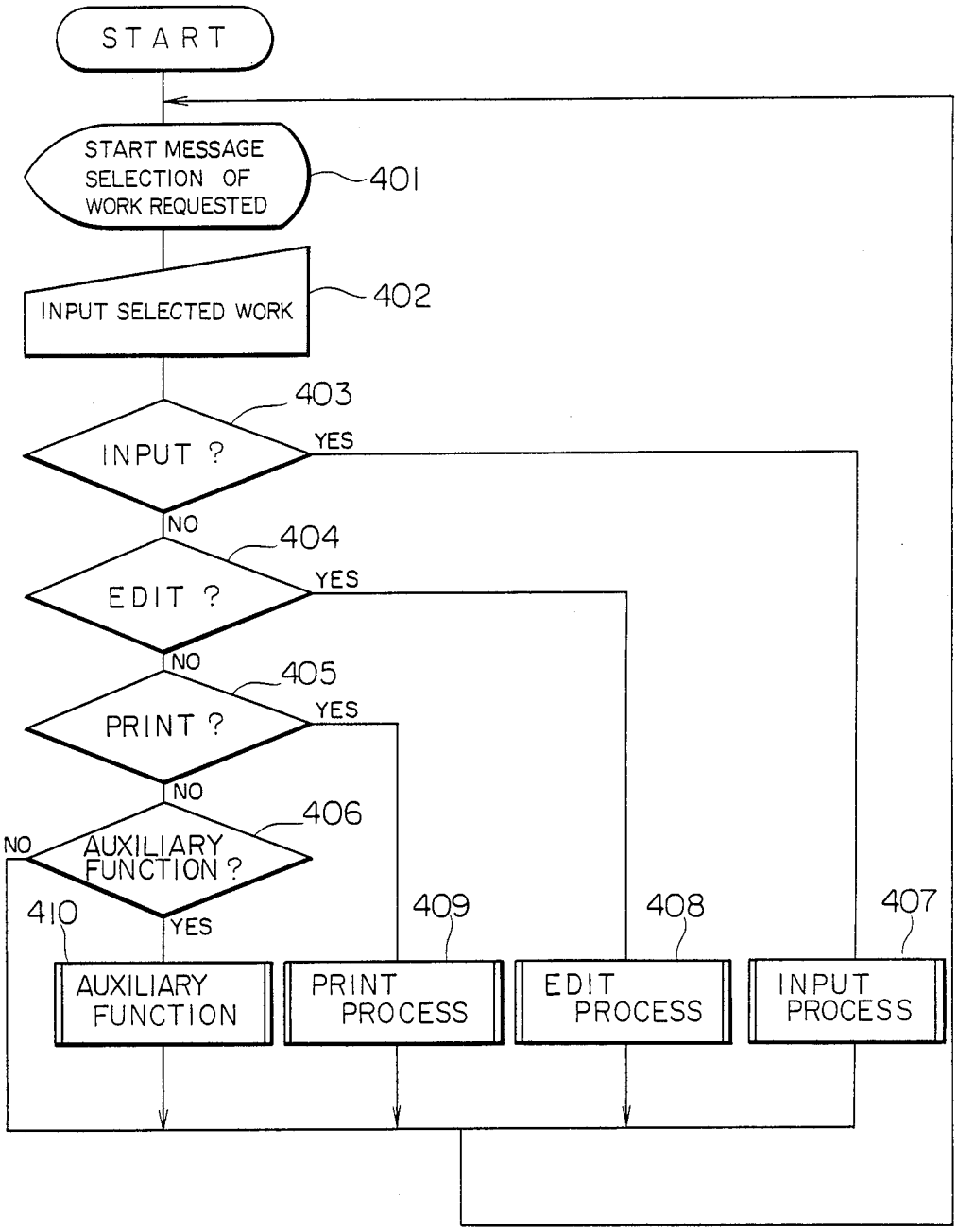
FIG. 4 is a flowchart for the operation program of the word processor.

The overall operation of this word processor will be explained. When the power supply is turned on in the above-described arrangement, the host CPU 251 shifts the program for making this image display apparatus operative as a word processor having such a data processing flow as shown in FIG. 4 into the program memory 253 from the flexible disk enclosed in the FDD 24 in accordance with the program in the boot ROM 252. Thereafter, the host CPU 251 starts the operation as a word processor in accordance with the program shifted into the program memory 253. Further, the program for performing the CRT display operation is also simultaneously shifted from the flexible disk inserted in the FDD 24 into a memory 122, which will be explained later, by a CPU 111 for controlling the CRT display circuit 254, which also will be described later.

In the data processing flowchart in FIG. 4, in processing step 401, a process start message as a word processor and a processing work menu which can be executed are displayed on the CRT monitor 23. In processing step 402, the selected work menu input which is designated by the operation of the keyboard by the operator is read. In processing step 403, a check is made to see if the instructed work is the input processing work or not. In processing step 404, a check is made to see if the designated work is the edit processing work or not. In processing step 405, a check is made to see if the designated work is the print processing work or not. In processing step 406, a check is made to see if the designated work is the auxiliary function processing work or not. The processing routine is branched from the respective processing steps to the relevant processing works 407 to 410. If the designated work is not for any of the above-mentioned works in the respective processing steps 403 to 406, the processing routine is returned to processing step 401. The foregoing "auxiliary function" is a general denomination of the function of which a function such as to copy the document data in the flexible disk into other flexible disk and the like are assembled.

Figure 5:
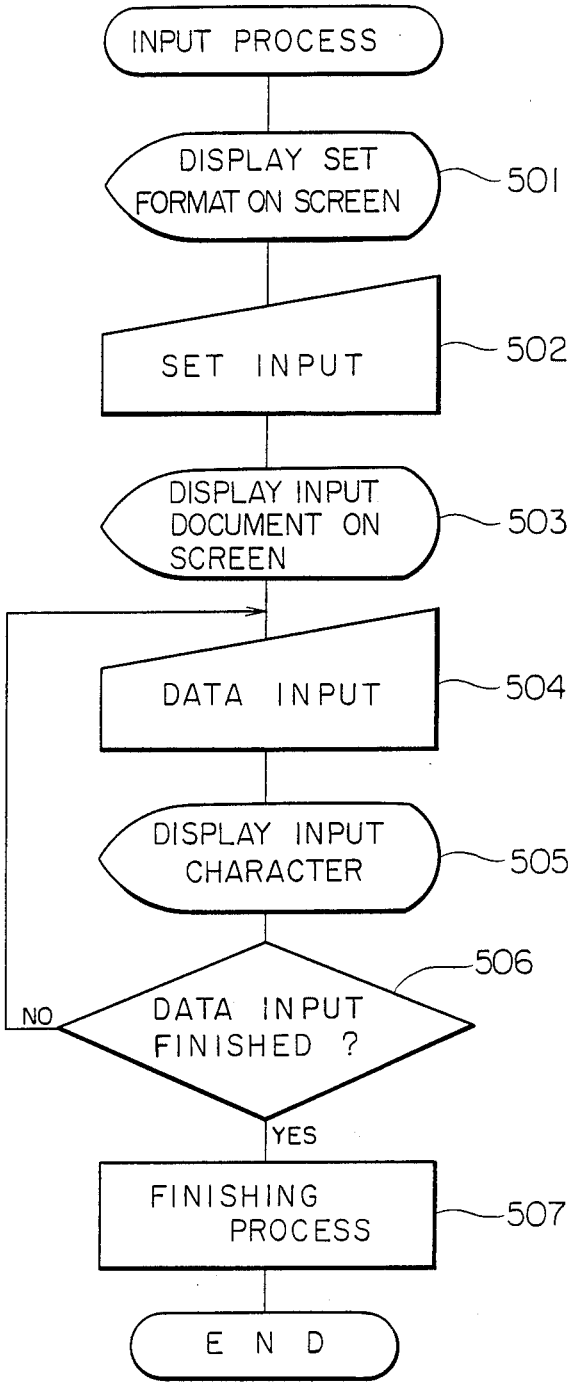
FIG. 5 is a flowchart for the input process in the operation program of the word processor.

When the input process 407 is selected by way of the work menu selection input, the host CPU 251 executes the input processing program having a data processing flow as shown in FIG. 5. The document data during the input processing operation is transmitted as a command and data to the CRT display circuit 254 through a signal line a in accordance with the program to execute the input data process as shown in FIG. 5 in the program memory 253. The CRT display circuit 254 produces an image pattern and converts it to a video signal and then supplies this video signal to the CRT monitor 23, thereby allowing the corresponding image to be displayed on the screen of the CRT monitor 23. The instruction of the process in association with the input of data into the document data is performed in accordance with the data or function instruction inputted by the keyboard 21.

In the data processing flowchart in FIG. 5, in processing step 501, the set format of the input document is displayed on the CRT monitor 23. In processing step 502, the set input which is inputted from the keyboard by the operator is read. In processing step 503, the input data based on the set format is displayed on the screen. In processing step 504, the data input from the keyboard 21 is read. This readout data is displayed in processing step 505. In processing step 506, a check is made to see if the end of data input work is inputted or not. If the data input work is not finished yet, the processing routine is returned to step 504. If the data input work has been completed, processing step 507 follows and the finishing process is executed and then the processing routine is returned to the data processing flow of FIG. 4. The finishing process 507 is the process such as to write and store the inputted data on the flexible disk or the like.

In case of allowing the CRT display circuit 254 to display only characters, the data corresponding to the display characters of one line on the screen constitutes one unit of data which is supplied from the host CPU 251 to the CRT display circuit 254 in response to an instruction of the program stored in the program memory 253. In other words, the host CPU 251 transmits the data of one line of which the new display character was added to the end of the line in correspondence to the character input for every character which is inputted from the keyboard 21 to the CRT display circuit 254 through the signal line a.

Although the operator sequentially inputs characters one by one, the host CPU 251 and CRT display circuit 254 have to perform the display process of the data of one line. Therefore, for the input process in the host CPU 251 and further for the image display process on the screen in the CRT display circuit 254, a high data processing speed is required to eliminate the waiting time of the operator.

In the edit process 408 in FIG. 4, the content on the screen is rewritten in accordance with the function key input which is inputted from the keyboard 21. Even in other processes as well, the instructions of the works, the elapse of time, and the like are displayed on the CRT monitor 23.

The CRT display circuit 254 will be explained.

Figure 1:
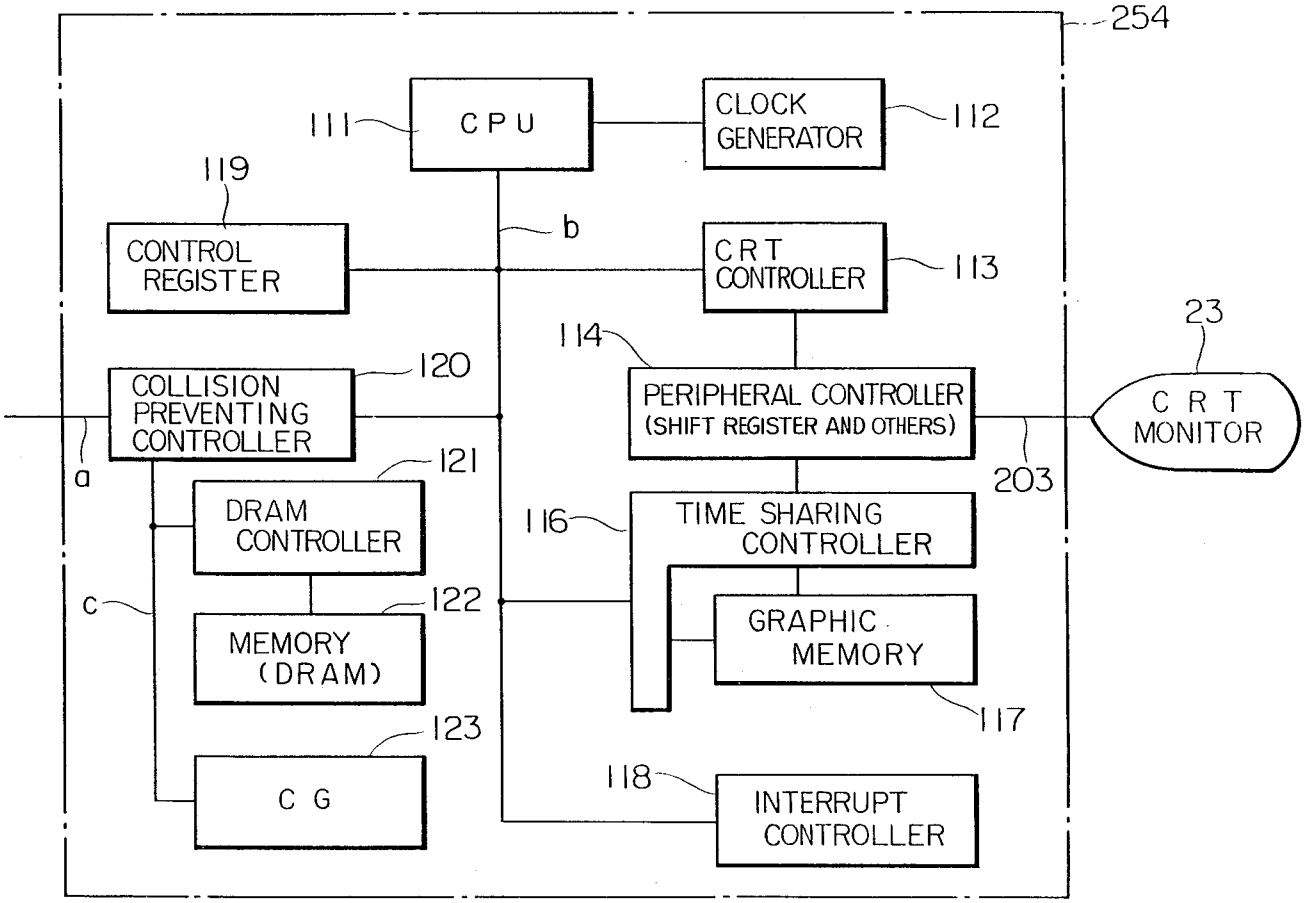
FIG. 1 is a block diagram of an image display apparatus according to the present invention.

FIG. 1 shows a block diagram of one embodiment of the CRT display circuit 254. The CRT display circuit 254 shown in FIG. 1 comprises: the CPU 111 for controlling the whole CRT display circuit (for example, Model 8086, 8088 or the like made by Intel Inc. is suitable for this CPU); a clock generator 112 for supplying signals such as a clock necessary for the CPU 111 and the like; a CRT controller 113 which produces address signals to sequentially read out the content of a graphic memory 117 and also generates a sync signal to control the CRT monitor 23; a peripheral control circuit 114 consisting of a shift register to convert parallel data from the graphic memory 117 into a serial video signal, a driver to supply the sync signal from the CRT controller 113 to the CRT monitor 23, and the like; the CRT monitor 23 which receives the video signal and sync signal and displays an image; a time sharing control circuit 116 which time sharingly controls the access signal from the CPU 111 and the access signal from the CRT controller 113 and supplies these signals to the graphic memory 117, thereby allowing the data from the memory to be transmitted to them, respectively; the graphic memory 117 consisting of a dynamic RAM of 128 kilobytes (64 kilobits ×16-bit word, wherein this dynamic RAM is accessed from the CPU on a byte unit basis of eight bits) in which a memory element corresponding to each bit of the image bits of the screen exists as a bit map; an interrupt controller 118 which supplies an interrupt signal to the CPU 111, thereby branching the program in accordance with the requirements from the host CPU 251 shown in FIG. 2 which is in the higher stage of the CRT display circuit 254 and from the outside; a control register 119 for holding control information such as shift readout control bits, write control bits or the like; a collision preventing control circuit 120 for multiple-controlling the access from the CPU 111 to the memory 122 and a CG (character generator section) 123 and the access signal from the host CPU 251 in FIG. 3; a DRAM controller 121 for producing a multiplexing address signal to the memory 122 and controlling the refreshing operation; the dynamic RAM 122 for dynamically holding the storage data (hereinafter, refrerred to as a DRAM); and the character generator section (hereinafter, referred to as a CG) 123 consisting of a ROM for storing Chinese characters, katakanas, alphanumeric characters or the like as a dot matrix pattern.

The host CPU 251 and CRT display circuit 254 in FIG. 3 are connected by the control signal and data signal line a. In the CRT display circuit 254, the CPU 111, CRT controller 113, time sharing control circuit 116, interrupt controller 118, control register 119, and collision preventing control circuit 120 are mutually connected by a CPU bus b. There is provided a memory bus c which receives the access signals on the signal lines a and b and supplies them to the DRAM controller 121 and CG 123.

Figure 6:
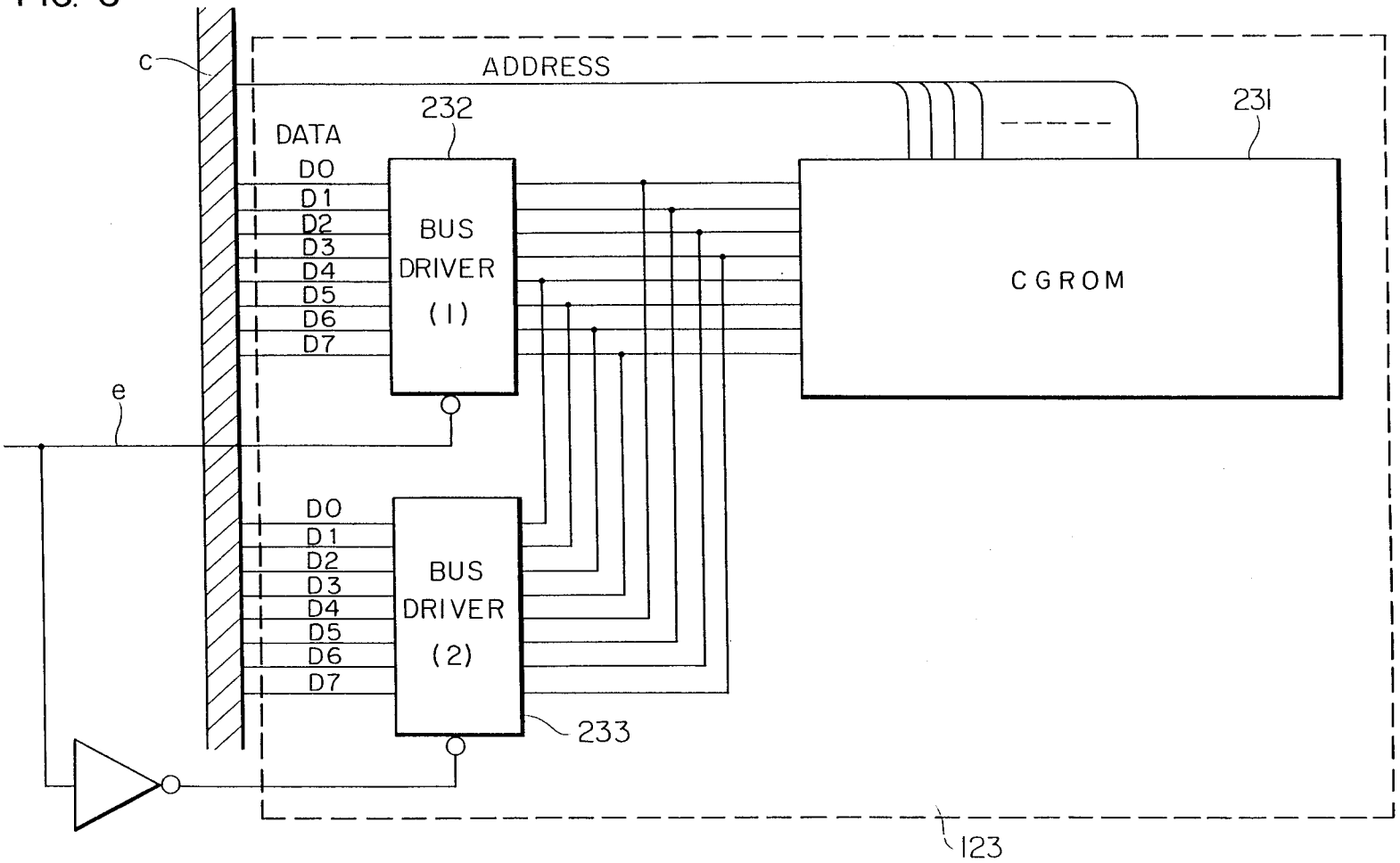
FIG. 6 is a detailed block diagram of a CG.

The CG 123 is then shown in detail in FIG. 6.

The CG 123 comprises: a CGROM 231 consisting of a plurality of ROMs; a bus driver 232 which serves to supply the one-byte data in the CGROM 231 designated by the address signal from the internal bus of the memory onto the data line of the memory bus c and which supplies the content of the CGROM 231 as it is onto the data line of the memory bus c; a bus driver 233 which exchanges the data in the CGROM 231 on a 4-bit unit basis and then supplies it onto the bus c, and the like. A signal line e is set into the control register 119 by the CPU 111 and serves to transmit the signal which is supplied from the control register 119.

Figure 7:
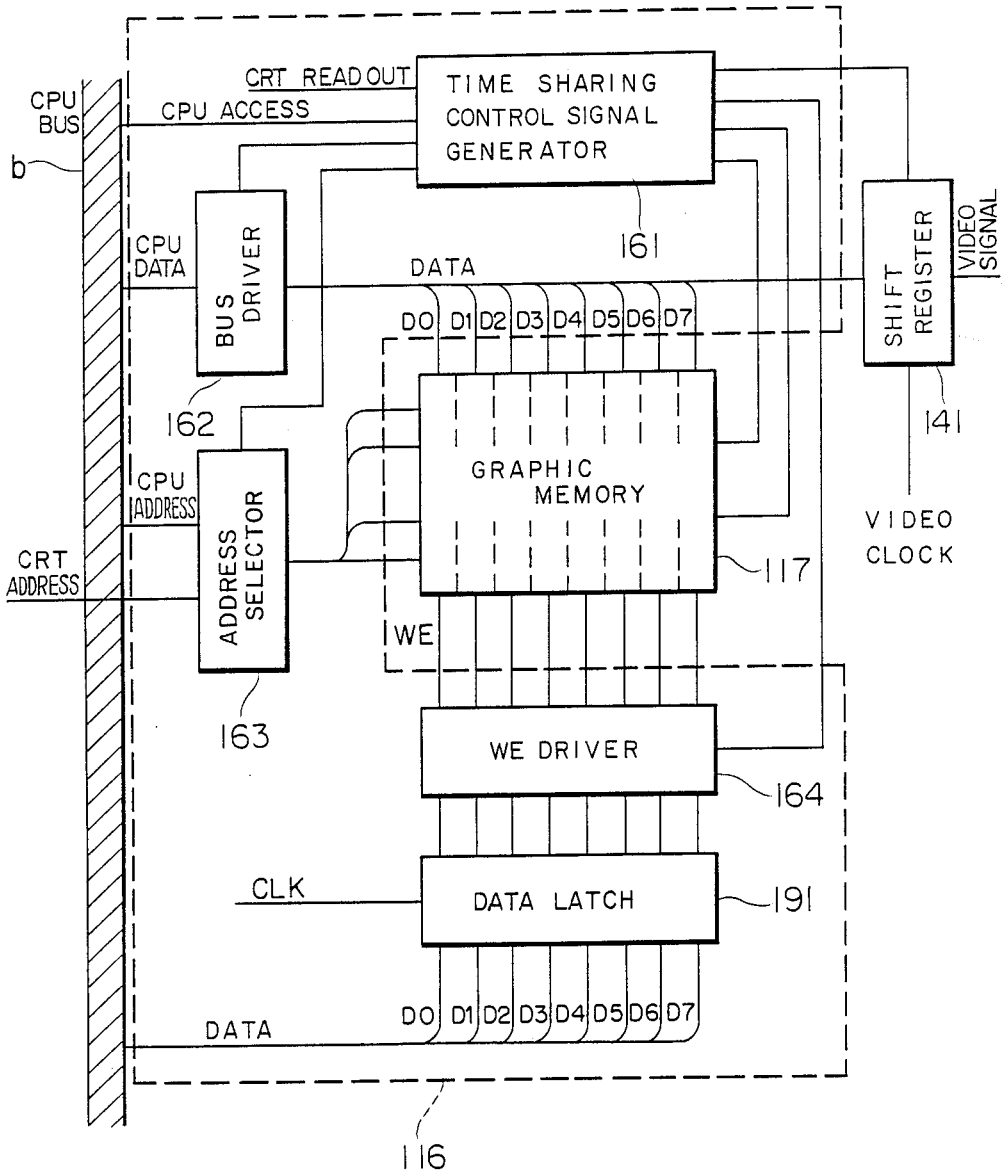
FIG. 7 is a block diagram of a circuit section regarding the WE control.

Further, FIG. 7 shows a circuit section regarding the writing control in the time sharing control circuit 116 and graphic memory 117.

The control signal to the graphic memory 117 is given from a time sharing control signal generator 161. As peripheral circuits of the graphic memory 117, the following circuits are connected to the memory 117: an address selector 163 to switch the address upon readout from the CRTC 113 and the address upon access from the CPU 111; a shift register 141 to convert the parallel data read out due to the access from the CRTC 113 into the serial video signal; a bus driver 162 to perform the transmission and reception of data with the CPU bus b upon accessing from the CPU 111; a data latch 191 which is a part of the control register 119 to control the mask of a write control signal WE to control the writing into the graphic memory 117 on a bit-unit basis; and a WE driver 164 which supplies the WE signal to the memory 117 upon writing from the CPU 111 in accordance with the content of the data latch 191, and the like.

Figure 8:
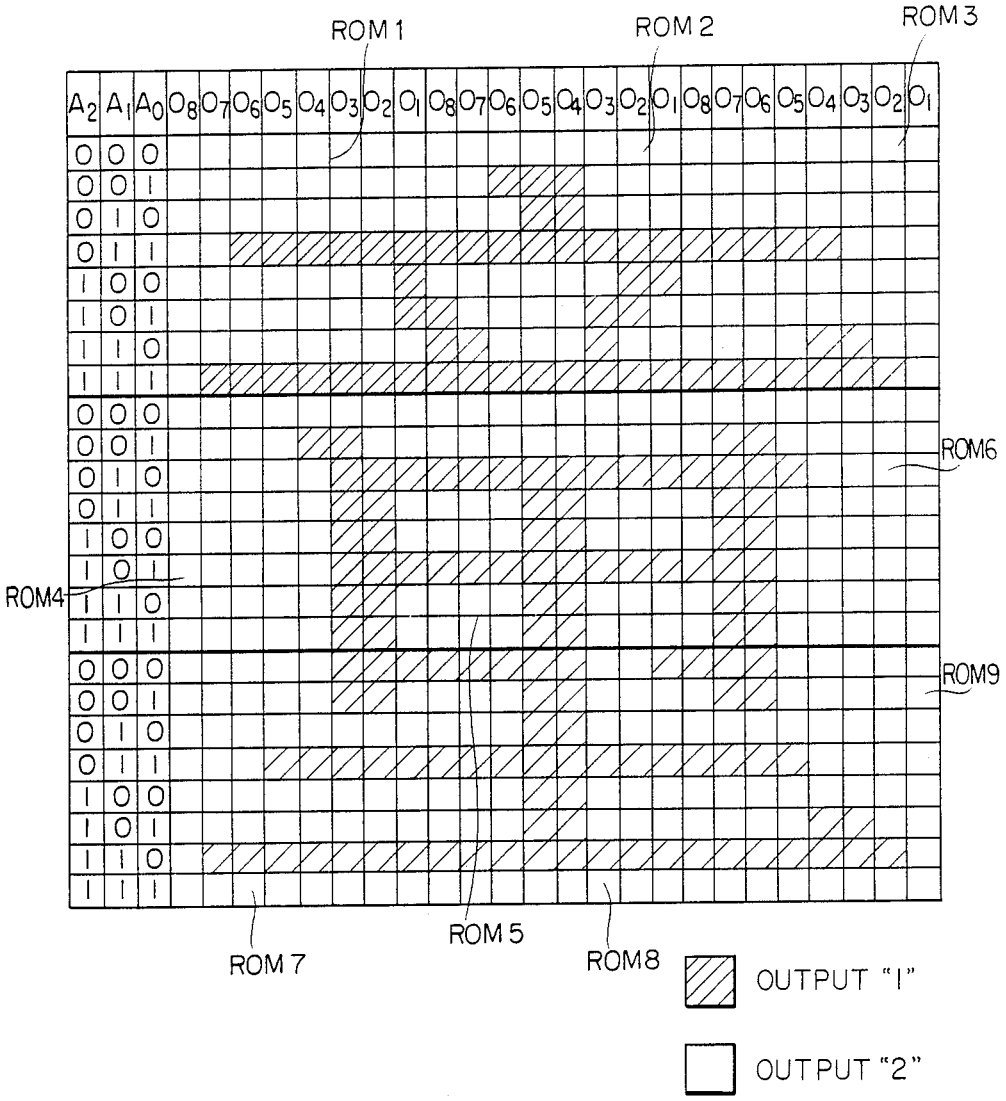
FIG. 8 is a diagram showing a pattern arrangement and addresses in a conventional CGROM.

An arrangement of the CGROM 231 will then be explained in detail with reference to the drawings. FIG. 8 shows a Chinese character "立" as an example to explain a method of storing a character pattern into a ROM in case of using a character generator ROM (for example, HN613256 PA10 to PA18 which are sold by Hitachi, Ltd. may be used as this CGROM) of 24×24 bits which is conventionally commercially available. In this ROM, to fit the apparatus for the code refresh display circuit system, one character is divided into patterns of 8×8 bits and the dot pattern of one character is stored by a total of nine ROMs. This means that the code refresh system has such an advantage that it is sufficient to constitute the minimum hardware to derive the character number and raster data of the CG from the raster addresses. However, in the bit map display system whereby the readout from the CG 123 is performed by the CPU 111 and the display pattern is written into the graphic memory 117 as described in this embodiment, when the adjacent patterns each consisting of 8×8 bits are read out by the CPU 111, the address of the pattern stored in the next ROM exists in the space which is 32 kilobytes apart, so that the addressing register has to be operated whenever the patterns are read out; therefore, this bit map display system is undesirable for the CG readout process. Therefore, in this embodiment, as an arrangement of the CGROM suitable for the control by the CPU, as shown in FIG. 9, a pattern of 24×24 bits is divided into sub-patterns each consisting of 8×24 bits on a byte unit basis and these subpatterns are sequentially stored into one ROM, thereby constituting the alignment type CG. The addresses when all ROMs are arranged in order are indicated as hexadecimal numbers.

An address arrangement of the graphic memory 117 will then be explained with reference to the drawings.

Figure 10:
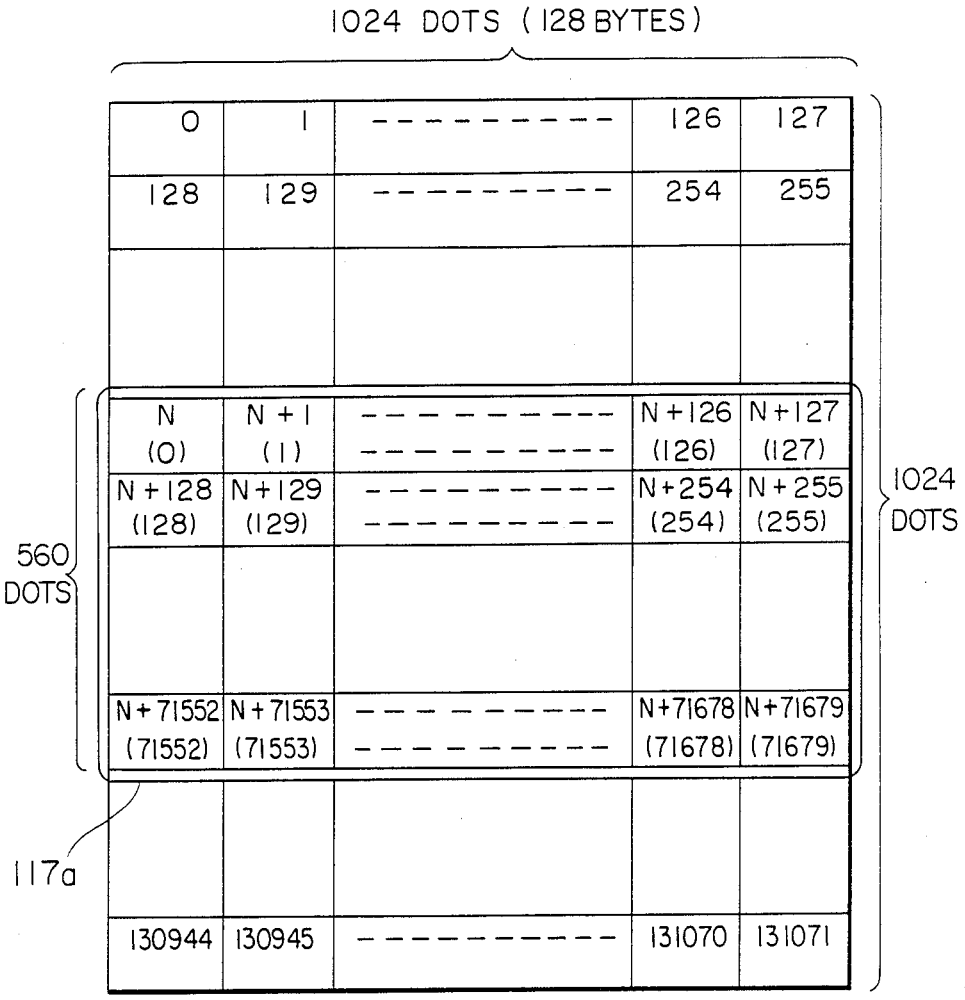
FIG. 10 is a diagram showing an address arrangement in a conventional graphic memory.

The video signal is constituted on a raster unit basis as a series signal of image bits. Namely, the readout from the CRTC 113 to refresh the screen is executed from the beginning of the screen on a 16-bit unit basis. The bits are sequentially series-converted from the MSB of the first sixteen bits and after the LSB of these bits, the MSB of the next sixteen bits follows. FIG. 10 shows an address arrangement in a conventional graphic memory. A region 117*a* corresponds to a display region on the CRT screen.

On the other hand, when a character pattern of 24×24 bits is processed by the CPU, the data of a thickness of three bytes is processed in the raster scan direction, while the data of a thickness of twenty-four bytes is processed in the vertical direction of the raster. In case of the Model 8086 or 8088 made by Intel Inc. which is used as the CPU 111, a string instruction is prepared for the repetitive processes of the continuous addresses. In other words, the data of the number of bytes designated is transferred from the source address designated in a predetermined register to the destination address designated in the predetermined register by way of the minimum instruction steps for the stortest processing time. To obtain the maximum effect in this processing method, it is effective to set the number of bytes which are transferred at a time to a large value. In consideration of this point, the addresses in the graphic memory 117 should be arranged in the vertical direction of the raster with respect to the CPU 111.

Figure 11:
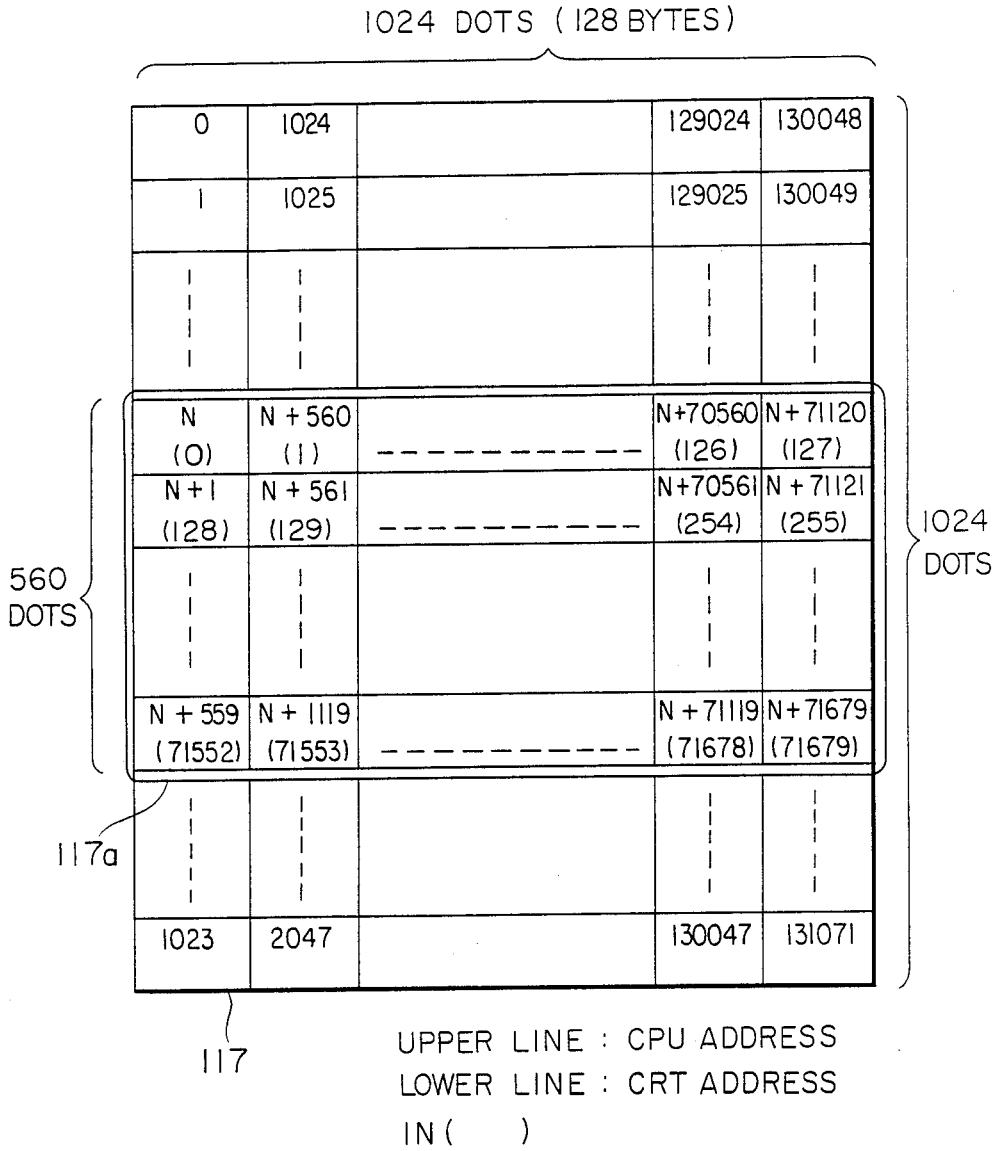
FIG. 11 is a diagram showing an address arrangement of a graphic memory according to the invention.

FIG. 11 shows an address arrangement in the graphic memory 117 in this embodiment. To realize this address arrangement, the correspondence between two groups of inputs comprising the CRT addresses and CPU addresses to the address selector 163 shown in FIG. 7 and the address outputs into the graphic memory 117 are as shown in Table 1.

In the memory addresses, a bank switching denotes selection signals each consisting of eight bits in the DRAM of a 16-bit arrangement; RA0 to RA7 indicate RAS addresses in the DRAM; and CA0 to CA7 represent CAS addresses.

TABLE 1

| CRT address | CPU address | Memory address |
|---|---|---|
| CA 0 | A 10 | Bank switching |
| CA 1 | A 11 | CA 0 |
| CA 2 | A 12 | RA 0 |
| CA 3 | A 13 | RA 1 |
| CA 4 | A 14 | RA 2 |
| CA 5 | A 15 | RA 3 |
| CA 6 | A 16 | RA 4 |
| CA 7 | A 0 | CA 1 |
| CA 8 | A 1 | RA 5 |
| CA 9 | A 2 | RA 6 |
| CA 10 | A 3 | RA 7 |
| CA 11 | A 4 | CA 2 |
| CA 12 | A 5 | CA 3 |
| CA 13 | A 6 | CA 4 |
| CA 14 | A 7 | CA 5 |
| CA 15 | A 8 | CA 6 |
| CA 16 | A 9 | CA 7 |

Similarly to the foregoing alignment type CGROM 231, by combining the address arrangement of the graphic memory 117, the arrangement fitted for the process by the CPU is obtained.

The operation will then be explained. The area of one Chinese character which occupies the bit map memory consists of 24 (in the lateral direction)×28 (in the longitudinal direction) bits in case of the full-sized character, while it consists of 12×28 bits in case of the half-sized character. In the longitudinal direction, twenty-four bits are assigned for the character pattern section, and four bits are assigned for the space between lines or as an area for an underline or a transversal ruled line. A vertical ruled line is overlaid in the area of 24 bits of a character pattern.

Instructions regarding the screen display from the host CPU 251 are inputted into the information transfer area in the memory 122 through the signal line a shown in FIG. 1, while avoiding the collision with the access by the CPU 111 in the CRT display circuit 254 by way of the collision preventing control circuit 120. When the information is set, the host CPU 251 generates an activation signal to the interrupt controller 118. The processing program is activated due to the interruption, so that the CPU 111 executes the screen control, data writing process and the like. The screen control includes the extinction of the whole screen, screen scroll and the like. For the writing, the data of every line is transferred as a unit to the CPU 111 from the host CPU 251 even in case of the writing of the new data, or the overlap writing of the new data on the previous screen, or the addition writing of the new one line due to the scroll.

Figure 12:
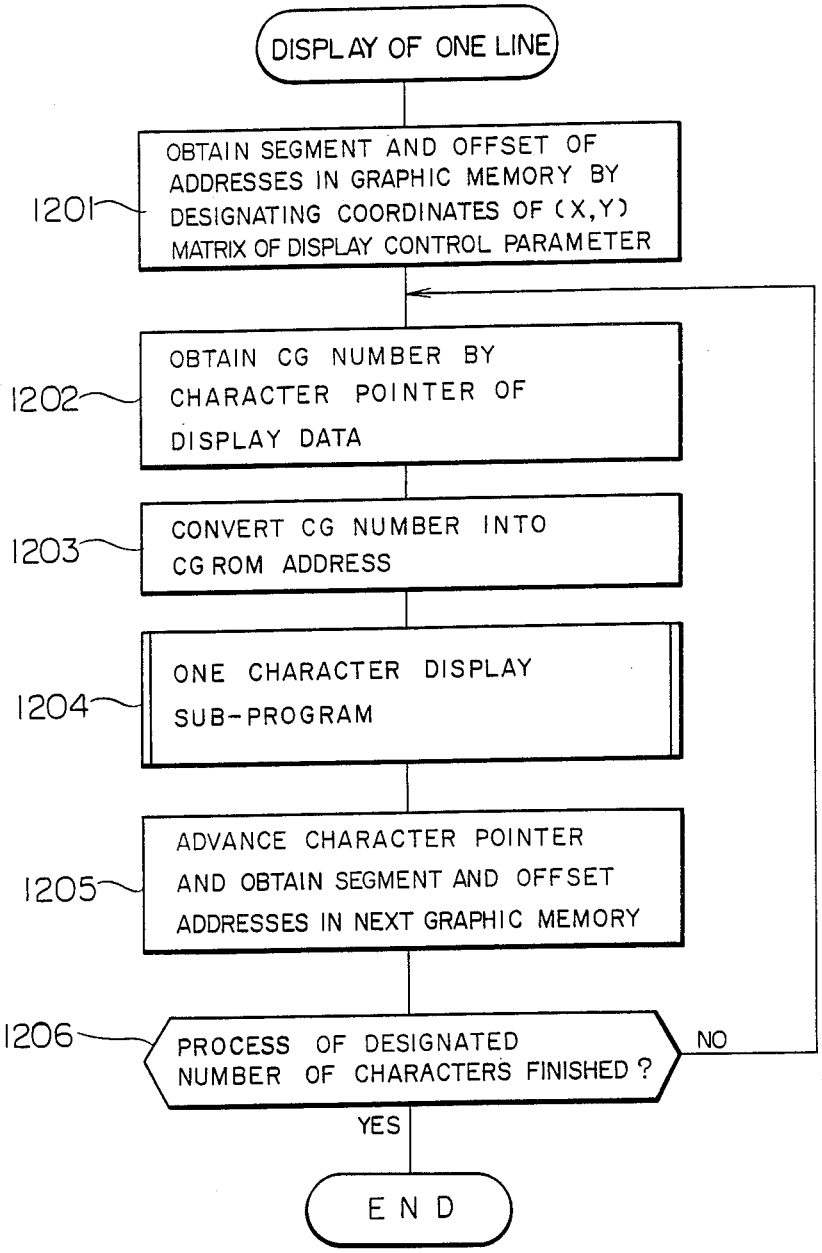
FIG. 12 is a flowchart for the program to display one line which is executed by a CPU to operate as an image display apparatus according to the invention.

When the display data of one line is prepared in the information transfer area in the memory 122 and the data writing is given as a command and the actuation is performed by the interrupt controller 118, the program to perform the control as the CRT display circuit stored in the memory 122 is actuated. In this case, since the writing into the information transfer area in the memory 122 has been given as a command, the CPU 111 executes the program having a flow shown in FIG. 12.

In this flowchart, first, in processing step 1201, the matrix values (X, Y) indicative of the head of one line to be displayed are derived from among the display control parameters in association with the display data in the information transfer area in the memory 122, then the corresponding address in the graphic memory 117 is calculated. Next, in processing step 1202, the CG number is obtained by taking out one character from among the character data of the display data in accordance with the pointer indicative of the character to be displayed. Thereafter, in processing step 1203, the CG number is converted to the address in the CGROM 231. The processing routine is branched to sub-program processing step 1204 for display of one character which will be explained later using the address in the graphic memory 117 and the address in the CGROM 231 as factors. After completion of the display of one character, processing step 1205 follows and the character pointer representing the position of the character data to be displayed is advanced by one. Further, in processing step 1206, a check is made to see if the display process is finished or not with respect to the number of designated display characters among the display control parameters associated with the display data in the information transfer area in the memory 122. Unless the display process is finished, the processing routine is returned to step 1202 and the next character is displayed. If the display process has been finished, the process is completed.

Figure 13:
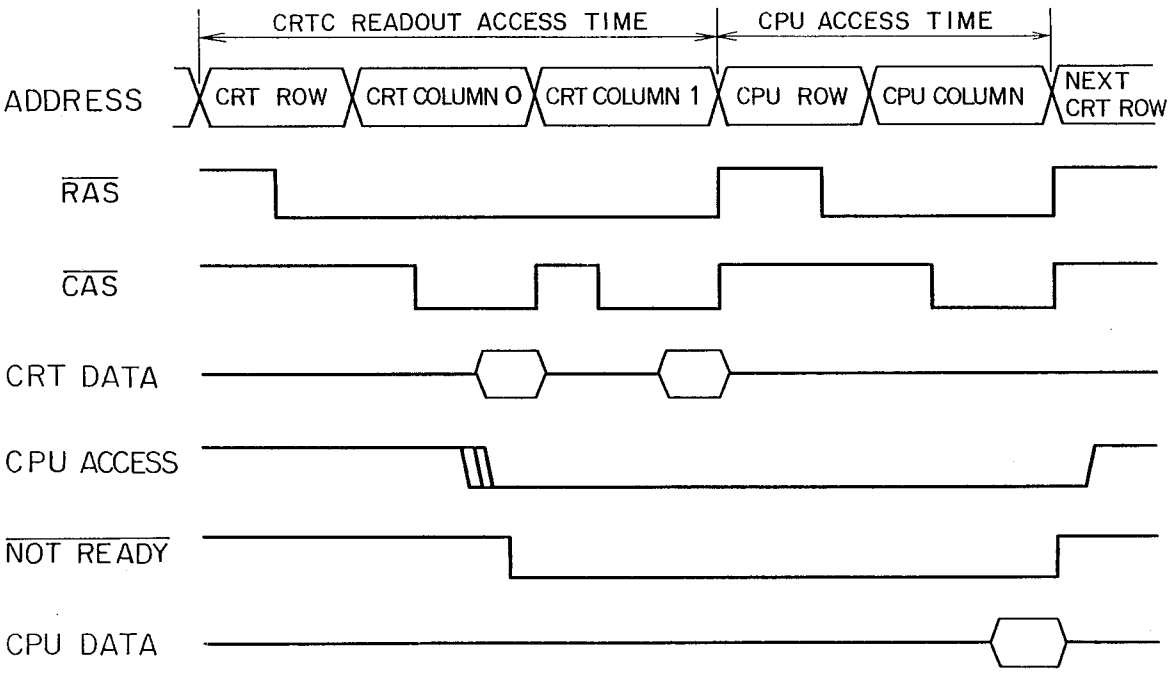
FIG. 13 is a timing chart showing the time sharing control for the readout from a CRTC and the access from the CPU.

To write the pattern to be displayed on the screen, the writing access into the graphic memory 117 is performed by the CPU 111. Simultaneously, to carry out the screen display of the CRT monitor 23, this pattern has to be read out from the CRT controller 113 and the screen has to be refreshed. To ensure that the above-mentioned operations are seemingly simultaneously executed, the time sharing control circuit 116 determines the readout time from the CRTC 113 to refresh the screen and the access time from the CPU 111 as shown in FIG. 13, thereby refreshing the screen such that the video signal which is given to the CRT monitor 23 is not interrupted. When accessing from the CPU 111, there is performed a control to make the access by the CPU 111 by a "Not Ready" signal wait until the time reserved for the CPU 111.

FIG. 13 is a timing chart showing when the access from the PCU 111 is performed. In the case where the access from the CPU 111 is not performed within the CPU access time, the CAS signal is not generated and the address and the RAS signal to the graphic memory 117 as a function of the DRAM are made invalid.

The operation when this apparatus is used will then be explained with regard to two kinds of operations: one is the processing operation from the CPU to form a pattern on the screen in the graphic memory; and the other is the operation to sequentially read out the patterns produced from the graphic memory and to display them on the CRT monitor 23.

(1) Process from the CPU

Display information is recorded by writing "1" (bright dot) or "0" (black dot) into the graphic memory on a bit-unit basis. For the display of a character, the pattern of the designated character is written into the byte addresses in the graphic memory 117 by the character generator 123 using a string instruction, thereby allowing the character to be displayed on the screen.

Figure 14:
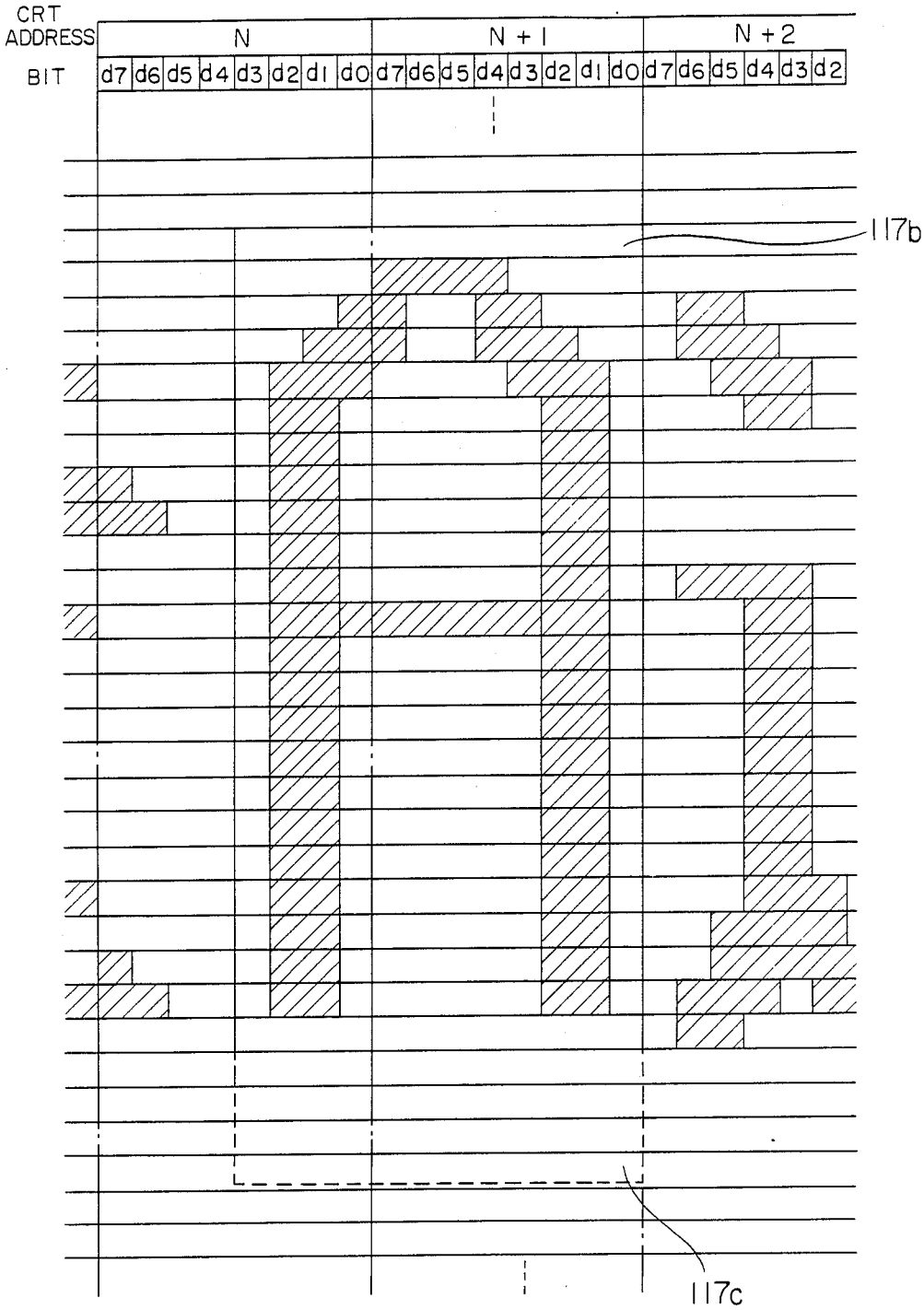
FIG. 14 is a diagram showing a graphic memory which displays a half-sized character "A".

With respect to the one character display sub-program process in the case where the half-sized character "A" (12×24 dots) as shown in FIG. 14 is newly displayed as one character, a comparison is made between the processing times in a conventional circuit and in the circuit according to this embodiment. In this case, it is assumed that the CPU 111 operates at the clock frequency of 15 MHz without waiting and further the instruction fetch is carried out during the internal process and the calculation is performed. A numeral 117*b* denotes a character pattern region and 117*c* is an underline or ruled line region.

Figure 15:
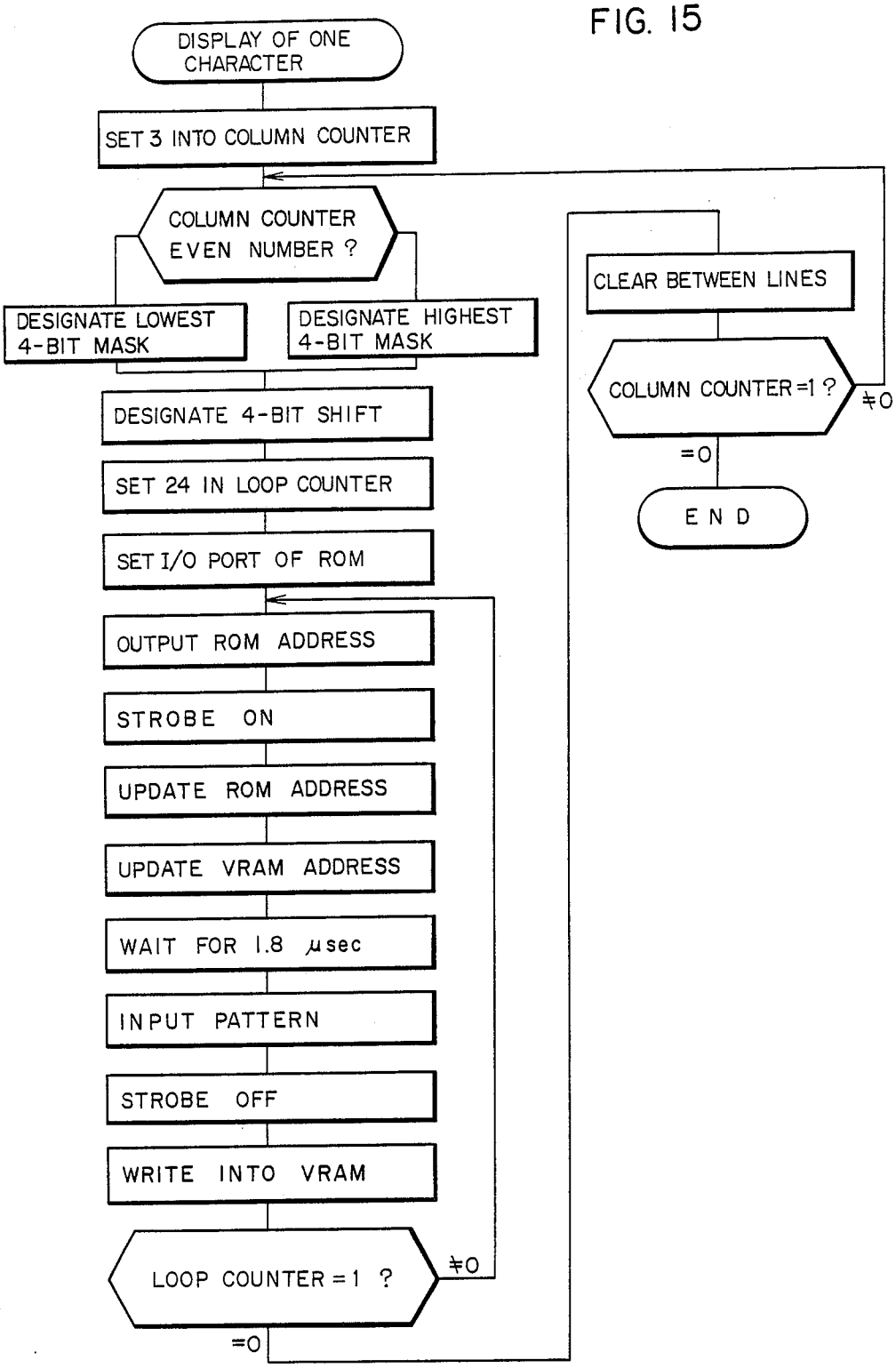
FIG. 15 is a flowchart for the writing process into the graphic memory in a prior art circuit.

FIG. 15 is a flowchart for the writing process by the conventional circuit, in which it takes about 1.12 msec (0.2 μsec×5600 clocks=1.12 msec) for the fundamental process to write the pattern of the half-sized character "A" into the graphic memory 117.

Figure 16:
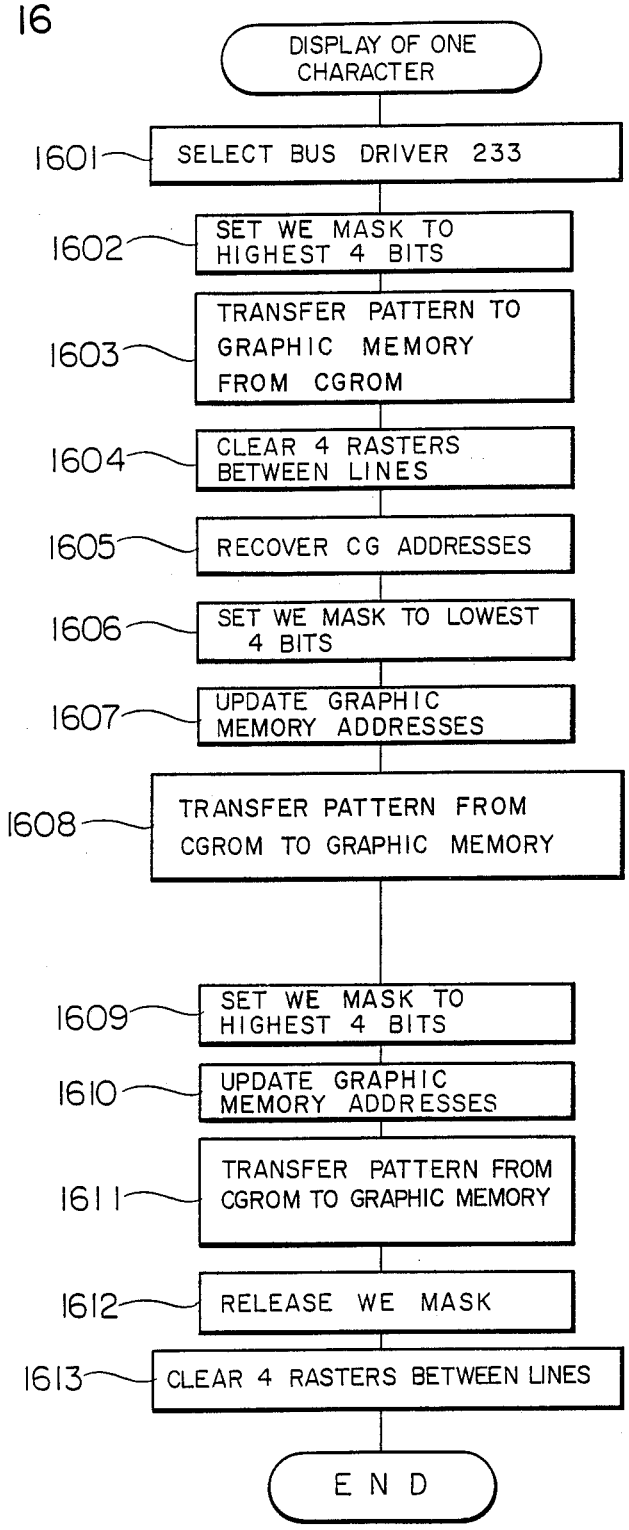
FIG. 16 is a flowchart for the writing process according to the present invention.

FIG. 16 shows a flowchart for the writing process according to this embodiment. In display of one half-sized character shown in FIG. 14, in processing step 1601, the shift readout from the CGROM 231 is set into the control register 119 and the bus driver 233 is selected. In next processing step 1602, a mask is set into the control register 119 to prevent the higher significant four bits from being written. In processing step 1603, the pattern data of 24 bytes is transferred from the CGROM 231 into the graphic memory 117. However, the pattern of 24×4 bits is written into the graphic memory 117. In the next processing step 1604, the content of the area between lines is cleared and then four bits on the right side are written. For this purpose, the CG addresses are recovered in processing step 1605. The mask is changed in processing step 1606. The addresses in the graphic memory are updated in processing step 1607. Then, 24×4 bits are written in processing step 1608. Finally, in processing steps 1609 to 1613, the process to transfer four bits on the left side from the CGROM is carried out twenty-four times in a similar manner as the process in the beginning, then the processing routine is finished.

In the process in the circuit of this embodiment, the pattern is transferred from the CGROM 231 into the graphic memory 117 by way of the string instruction, so that the program loop is eliminated. In addition, the pattern transfer which occupies most of the process is executed by the string instruction, so that the number of desired clocks becomes small. Consequently, it takes merely about 0.36 msec (0.2 μsec×1800 clocks=0.36 msec) for the fundamental process to write the pattern.

(2) Refreshing operation

The CRT controller 113 generates the readout signal to the graphic memory 117 in response to the synchronization timing for the CRT monitor control in accordance with the CRT addresses shown in ( ) in FIG. 11. The CRT controller 113 produces the addresses in accordance with the sequence of the positions on the screen and gives a read signal to the time sharing control signal generator 161. The generator 161 controls the address selector 163 in the CRTC readout time, thereby allowing the addresses to be supplied to the graphic memory 117. The data read out from the graphic memory 117 for the CRTC readout time is given to the shift register 141 and thereafter it is converted from parallel data to serial data in response to the video clock and is supplied as a video signal to the CRT monitor 23 through the drive circuit provided in the peripheral control circuit 114.

According to the foregoing embodiment, in the image display apparatus of the bit map display system, a character pattern such as a Chinese character or the like can be written into the graphic memory at a high speed by making the best of the characteristic of the CPU, so that it is possible to provide a character generator which is optimum for a Chinese character display circuit which can display graphics. In particular, in one character drawing process, as compared with a process in a prior art circuit, the high speed process can be performed by way of the string instruction in the circuit of the embodiment, so that the processing speed can be made higher by about three times.

As described above, by making the memory rewriting speed high, it is possible to reduce the response time in the interactive word processing operation which is performed by the operator, or the like. Thus, the operating efficiency is improved in the high speed input process of a Chinese character or in the edit process by way of exchange of the screen.

The alignment type CG arrangement is effective for the string instruction of the CPU. Similarly to this, the use of a DMA controller in which the DMA transfer between memories can be performed, although an example of such a DMA controller is not shown in the circuit of the embodiment, makes it possible to derive an effect similar to the foregoing effect irrespective of the kind of the CPU.

Although Model 8086 or 8088 of Intel Inc. is suitable as the CPU, the invention can be obviously similarly embodied even by other CPU having the function which is equivalent to that of such a CPU.

In the foregoing embodiment, to transfer the character pattern data from the CG 123 into the graphic memory 117, there is provided the address selector 163 for allowing the addresses in the graphic memory 117 with respect to the CPU 111 to be arranged in the arrangement direction of the scanning lines. However, as in the screen scrolling process, in the case where a large block in the graphic memory 117 is shifted, it is preferable to adopt an address arrangement such that the addresses in the graphic memory 117 are arranged in the same direction as the access direction by the CRT controller 113 (namely, in the scanning direction of the scanning lines).

Figure 17:
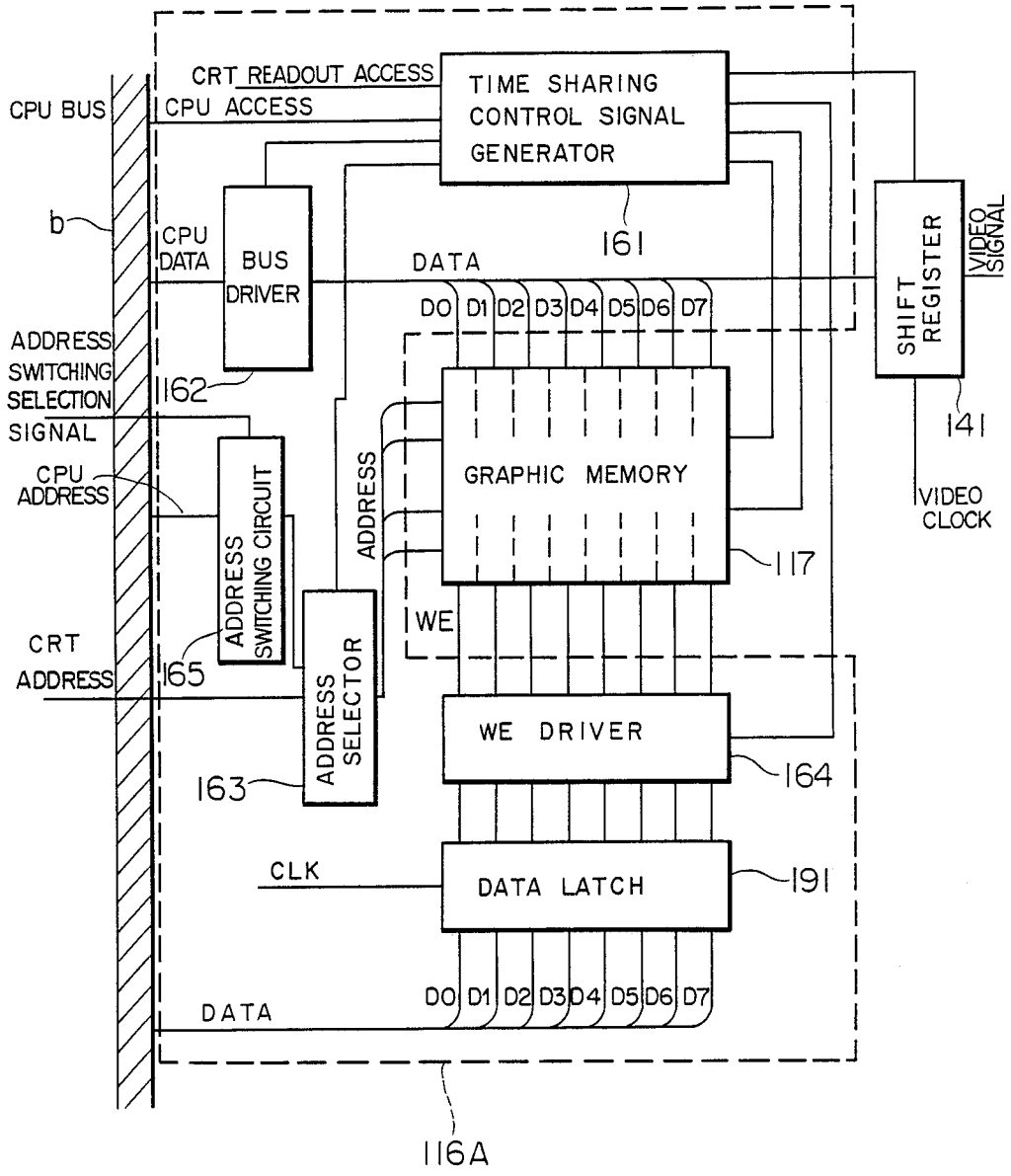

To realize such an address arrangement, the time sharing control circuit 116 shown in FIG. 7 is modified as shown in FIG. 17. In a time sharing control circuit 116A in FIG. 17, an address switching circuit 165 is connected between the CPU bus b and the address selector 163, and the address arrangement upon accessing from the CPU 111 to the graphic memory 117 is switched in response to an address switching selection signal which is generated from the CPU 111 and is latched in the control register 119. Otherwise, the circuit arrangement is substantially the same as the arrangement in FIG. 7.

Figure 18:
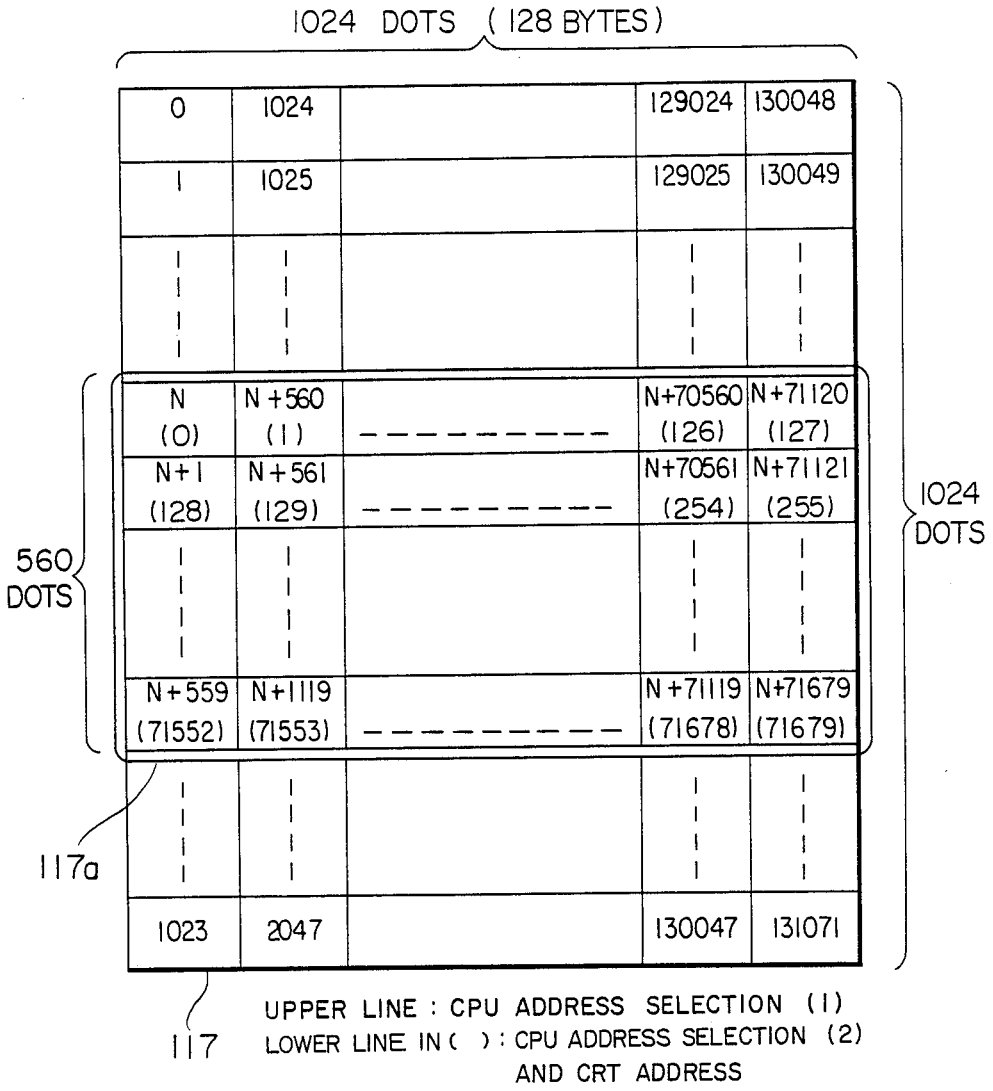

With this arrangement, as the access address arrangement in the graphic memory 117, it is possible to freely select either one of two kinds of access methods in the arrangement direction of the scanning lines and in the scanning direction of the scanning lines in accordance with an instruction of the CPU 111. FIG. 18 shows this selecting constitution in detail.

To realize the addresses shown in FIG. 18, the correspondence among two groups of inputs of the CRT addresses and CPU addresses to the address selector 163 shown in FIG. 17 and the addresses into the graphic memory 117 are as shown in Table 2. In this table, "Bank Switching" in the memory addresses denotes selection signals each consisting of an eight-bit block in the DRAM of a 16-bit constitution; RA0 to RA7 indicate the RAS addresses in the DRAM; and CA0 to CA7 represent the CAS addresses.

TABLE 2

| CRT address | CPU address selection (1) | CPU address selection (2) | Memory address |
|---|---|---|---|
| CA 0 | A 10 | A 0 | Bank switching |
| CA 1 | A 11 | A 1 | CA 0 |
| CA 2 | A 12 | A 2 | RA 0 |
| CA 3 | A 13 | A 3 | RA 1 |
| CA 4 | A 14 | A 4 | RA 2 |
| CA 5 | A 15 | A 5 | RA 3 |
| CA 6 | A 16 | A 6 | RA 4 |
| CA 7 | A 0 | A 7 | CA 1 |
| CA 8 | A 1 | A 8 | RA 5 |
| CA 9 | A 2 | A 9 | RA 6 |
| CA 10 | A 3 | A 10 | RA 7 |
| CA 11 | A 4 | A 11 | CA 2 |
| CA 12 | A 5 | A 12 | CA 3 |
| CA 13 | A 6 | A 13 | CA 4 |
| CA 14 | A 7 | A 14 | CA 5 |
| CA 15 | A 8 | A 15 | CA 6 |
| CA 16 | A 9 | A 16 | CA 7 |

As described above, the address arrangement in the graphic memory 117 is set to the CPU address selection (1), thereby making it possible to perform the access similarly to the alignment type CGROM 231, so that this arrangement becomes fitted for the character display process by the CPU 111. On the other hand, in the CPU address selection (2), the address arrangement becomes suitable for the scrolling process which is the block moving process of the content of the graphic memory 117 by the CPU 111. These CPU address selections (1) and (2) are switched by the address switching circuit 165.

Figure 19:
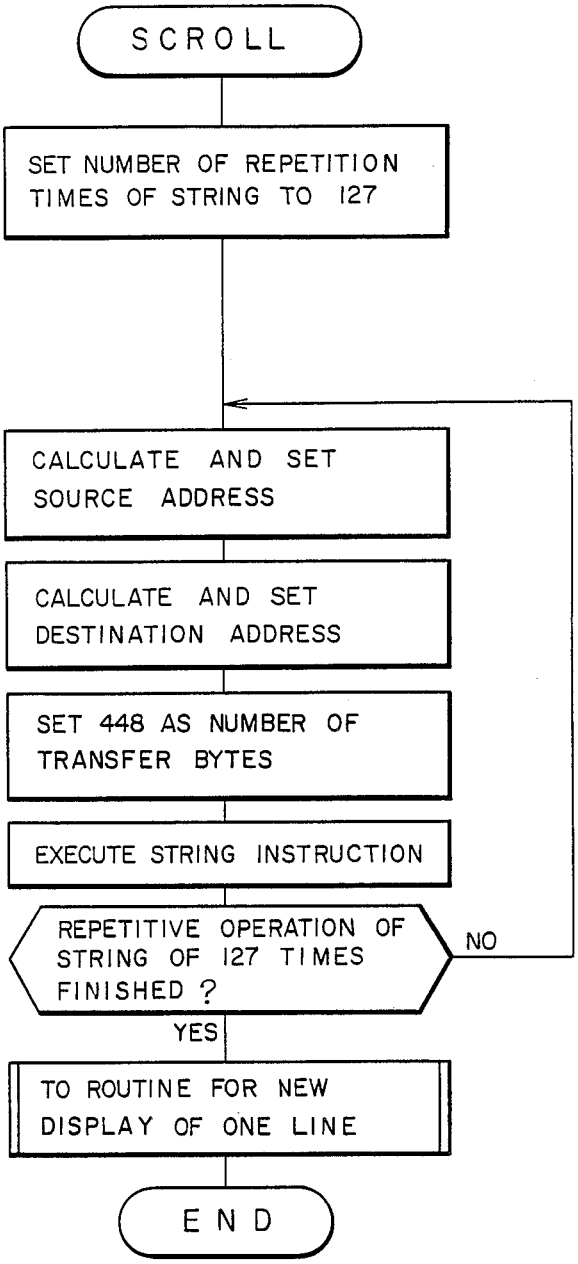

The scrolling operation will be explained. FIG. 19 shows a flowchart for performing the scrolling operation using the address arrangement of the address selection (1) in this embodiment in the case where the address switching is not performed. In this embodiment, the scroll operation is carried out in accordance with a flowchart shown in FIG. 20. In processing step 1701, the address selection (2) is set. In processing steps 1702 to 1704, parameters for the string operation are set. Namely, the address in the graphic memory 117 corresponding to the second line of the text is set to a source address and the address in the graphic memory 117 of the first line of the text is set to a destination address. The number of bytes in the graphic memory 117 from the second line of the text to the last seventeenth line of the text is set to a transfer byte number. In processing step 1705, 57344 bytes designated by one transfer string instruction are transferred. Thereafter, in processing step 1706, the display data of one line to be newly written in the 18th line is drawn.

Figure 20:
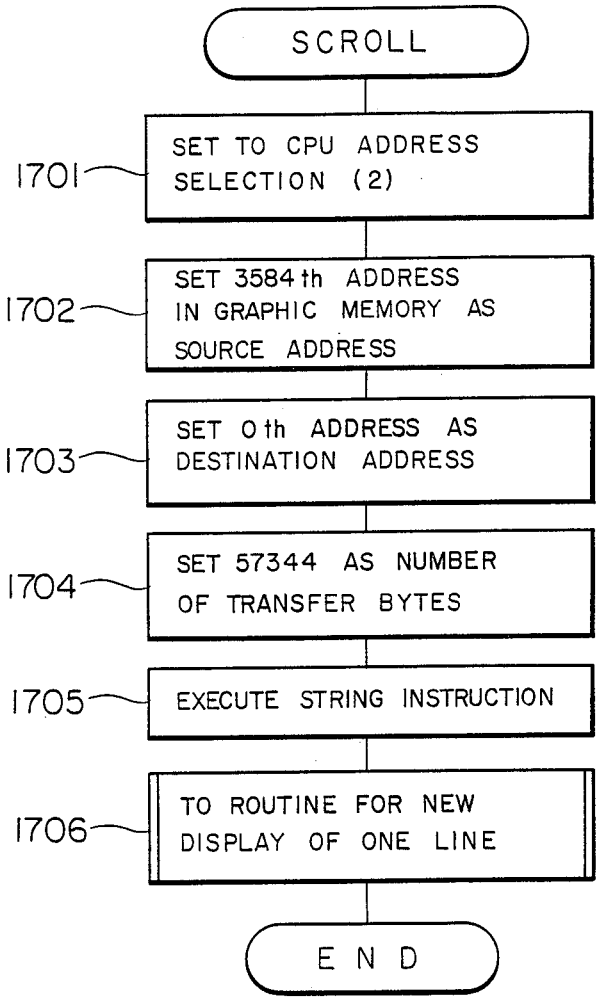

Although the processing speed is made high by the string instruction even in the case where the address switching is not performed, if the address arrangement is further switched, the bytes can be transferred by one transfer string instruction as shown in FIG. 20. As compared with the flow shown in FIG. 19 whereby no switching is performed, it is sufficient to first perform the preparation before execution of the string instruction, so that the further high speed operation is obtained.

In the foregoing description, an example of the upward scroll in which the content on the screen seemingly rises from the bottom to the top is shown. However, even in case of the opposite downward scroll, a similar operation is performed excluding that the source address and destination address are different from those in the upward scroll.

We claim:

1. An image display apparatus comprising:

a computer unit having means for controlling a character generator to read out dot data of an image pattern and for writing said dot data into a bit map graphic memory;

a CRT controller having means for reading out the dot data from said bit map grahic memory by raster scanning in the horizontal direction, means for producing a video signal from the read-out dot data and means for supplying said video signal for display on a CRT monitor; and a time sharing control circuit for time sharingly controlling address signals for graphic memory access by said computer unit and graphic memory scan by said CRT controller;

wherein said character generator is provided with non-volatile memory means for storing a dot matrix of at least one character pattern which has been segmented on a byte-unit basis in the horizontal direction of a raster into a plurality of sub-patterns, said segmented sub-patterns being stored in said non-volatile memory means with said byte units being ordered sequentially in the vertical direction of the raster in each sub-pattern and following from the bottom of one sub-pattern to the top of an adjacent sub-pattern; and wherein said time sharing control circuit is provided with an address selector for selecting between address signals for the graphic memory access provided in a vertical scan sequence from said computer unit and address signals for the graphic memory scan in the horizontal scan direction from said CRT controller in accordance with a predetermined time sharing control.

2. An image display apparatus comprising:

writing means for controlling a character generator and accessing a graphic memory of the bit map type and for writing data of a predetermined image pattern generated from said character generator into designated addresses of said graphic memory so that said data is written in a vertical sequence under control by a CPU; and display means for the scanning type for reading out the image pattern written into said graphic memory by horizontal line scanning and for displaying said image pattern;

wherein said character generator is provided with a memory storing dot data of a character pattern dot matrix segmented on a byte unit basis in the horiztonal scanning direction of scanning lines of a raster and said data is stored in byte units sequentially in each segment in said memory in the vertical direction of said raster; and wherein said writing menas is provided with means for selecting the graphic memory access address sequence under control of the CPU to effect either access in the horizontal scanning direction or the vertical direction of the raster for access to the graphic memory.

3. An image display apparatus comprising:

a computer unit having means for controlling a character generator to read out dot data of an image pattern and for writing said dot data into bit map graphic memory;

a CRT controller including means for reading out the dot data from said bit map graphic memory by raster scanning in a horizontal direction and for supplying said video signal for display on a CRT monitor; and a switching circuit for switching between said graphic memory access by said computer unit and said graphic memory access by said CRT controller including an address selector for selecting between the graphic memoyr access from said computer unit and the graphic memory access from said CRT controller under control of said computer unit; and wherein said graphic memory is segmented on a byte unit basis in the scanning direction of scanning lines so that byte units of stored data are ordereed sequentially in each segment and follow from the bottom of one segment to the top of an adjacent segment with said segmented data as received from said charater generator being aligned with the vertical direction of the raster.

4. An image display apparatus set forth in claim 3, wherein a CPU operates to select one of two address sets including a first address set having a constitution such that raster scan data from said graphic memory is segmented on a byte unit basis and aligned in the scanning direction, and a second address set having a constitution that said memory is segmented on a byte unit basis in the scanning direction of scanning lines and segmented data is aligned with the vertical direction of the raster.

* * * * *